US009262947B2

(12) United States Patent
Ranger

(10) Patent No.: US 9,262,947 B2
(45) Date of Patent: Feb. 16, 2016

(54) APPARATUS AND METHOD FOR DISPLAY OF ELECTRONIC ADVERTISING

(75) Inventor: David Gregory Ranger, Caloundra (AU)

(73) Assignee: Total Range Design Pty Ltd, Currimundi (AU)

( * ) Notice: Subject to any disclaimer, the term of this patent is extended or adjusted under 35 U.S.C. 154(b) by 122 days.

(21) Appl. No.: 13/695,705

(22) PCT Filed: May 18, 2011

(86) PCT No.: PCT/AU2011/000602

§ 371 (c)(1), (2), (4) Date: Nov. 1, 2012

(87) PCT Pub. No.: WO2011/143717

PCT Pub. Date: Nov. 24, 2011

(65) Prior Publication Data

US 2013/0050060 A1 Feb. 28, 2013

Related U.S. Application Data

(60) Provisional application No. 61/345,597, filed on May 18, 2010.

(51) Int. Cl.

| | |
|---|---|
| ***G09G 5/00*** | (2006.01) |
| ***G09F 9/35*** | (2006.01) |
| ***G09F 15/00*** | (2006.01) |

(52) U.S. Cl.

CPC ..... *G09F 9/35* (2013.01); *G09F 15/0062* (2013.01)

(58) Field of Classification Search

CPC ..... G06F 15/0062; G06F 9/35

USPC ..... 345/1.1–1.3

See application file for complete search history.

(56) References Cited

U.S. PATENT DOCUMENTS 1,115,021 A * 10/1914 Pummill ..... 40/610
4,942,386 A 7/1990 Willis (Continued)

FOREIGN PATENT DOCUMENTS

CA 2568992 5/2008
CN 2577388 10/2013

(Continued)

OTHER PUBLICATIONS

New Zealand "Further Examination Report", SN 602955, dated Dec. 4, 2013.

(Continued)

*Primary Examiner* — Priyank Shah
(74) *Attorney, Agent, or Firm* — Boyle Fredrickson S.C.

(57) ABSTRACT

An apparatus for displaying electronic advertisements or the like is provided herein. In one embodiment, the apparatus may include a first planar body having a first electronic display and a second planar body having a second electronic display. The apparatus may include a connector for connecting the first and second planar bodies, and at least one controller component operatively coupled to the first and second electronic displays. The apparatus may include at least one alarm component attached to at least one of the first and second planar bodies, and at least one movement detection component operatively coupled to the at least one alarm component. The apparatus may include at least one power component operatively coupled to the first and second electronic displays and the at least one alarm component.

14 Claims, 2 Drawing Sheets

(56) References Cited

U.S. PATENT DOCUMENTS

| | | | | |
|---|---|---|---|---|
| 5,412,892 | A * | 5/1995 | Filippakis | 40/471 |
| 6,904,709 | B2 * | 6/2005 | Craig et al. | 40/590 |
| 2002/0111146 | A1 | 8/2002 | Fridman et al. | |
| 2004/0119602 | A1 * | 6/2004 | Blum et al. | 340/815.4 |
| 2006/0032098 | A1 * | 2/2006 | Glass | 40/610 |
| 2007/0234610 | A1 | 10/2007 | Pelak et al. | |
| 2008/0078097 | A1 * | 4/2008 | Lopez | 34/88 |
| 2011/0058326 | A1 * | 3/2011 | Idems et al. | 361/679.21 |
| 2012/0007343 | A1 * | 1/2012 | Webster et al. | 280/659 |
| 2013/0099926 | A1 * | 4/2013 | Peterson | 340/542 |

FOREIGN PATENT DOCUMENTS

| | | | |
|---|---|---|---|
| GB | 2387472 | | 10/2003 |
| KR | 2004-0054116 | A1 | 6/2004 |
| WO | 2009/135308 | A1 | 11/2009 |
| WO | 2010/028397 | A1 | 3/2010 |

OTHER PUBLICATIONS

European Search Report, SN EP11782783, dated Nov. 25, 2013.
New Zealand "First Examination Report", SN 602965, dated Aug. 8, 2013.

* cited by examiner

APPARATUS AND METHOD FOR DISPLAY OF ELECTRONIC ADVERTISING

CROSS-REFERENCE TO RELATED APPLICATIONS

This application claims the benefit of U.S. Provisional Application No. 61/345,597, filed May 18, 2010, entitled, "METHOD FOR AN ELECTRONIC ADVERTISING BOARD," which is hereby expressly incorporated in its entirety by reference herein.

BACKGROUND

I. Field

The present disclosure relates generally to communication systems, and more specifically to frequency spectrum allocation.

II. Background

The 'A'-frame advertising board, also named 'sandwich board' is known in the art. Implementations of this advertising board include a standard 'A' shaped frame with two flat surfaces on which sign-writing is applied. Another version is an 'A' frame with removable writing applied on both surfaces, where alternating text can be applied as required.

The problem with existing 'A'-frame advertising boards is their lack of adjustability. The standard 'A'-frame has sign writing painted on and to change any part of this a signwriter will need to paint over the existing artwork. An alternative is a surface with a chalkboard coating applied, on which changing artwork can be applied. The problem with this application is that it is not waterproof and smudges when touched. The 'A'-frame with removable writing is limited to the spacing and typeset provided. Accordingly, there is a need for a system that provides greater flexibility for the user to select, adjust, or revise the type of content (e.g., advertising) shown by the system.

SUMMARY

The following presents a simplified summary of one or more embodiments in order to provide a basic understanding of such embodiments. This summary is not an extensive overview of all contemplated embodiments, and is intended to neither identify key or critical elements of all embodiments nor delineate the scope of any or all embodiments. Its sole purpose is to present some concepts of one or more embodiments in a simplified form as a prelude to the more detailed description that is presented later.

In accordance with one or more embodiments and corresponding disclosure thereof, various aspects are described in connection with an apparatus for the display of content (e.g., advertising). For example, the apparatus may include a first planar body extending from a first top region (e.g., a first top edge) to a first bottom region, wherein the first planar body has a first electronic display between the first top and bottom regions. The apparatus may include a second planar body extending from a second top region (e.g., a second top edge) to a second bottom region, wherein the second planar body has a second electronic display between the second top and bottom regions. The apparatus may include a connector for connecting the first and second planar bodies near the first and second top regions. For example, the connector may be a hinge that connects the first and second edges and allows the first and second planar bodies to rotate relative to each other about a fixed axis of rotation.

In related aspects, the apparatus may include at least one controller component operatively coupled to the first and second electronic displays, wherein the at least one controller component may be configured to control content displayed on the first and second electronic displays. In further related aspects, the apparatus may include at least one alarm component attached to at least one of the first and second planar bodies. The apparatus may include at least one movement detector operatively coupled to the at least one alarm component. The apparatus may include at least one power component operatively coupled to the first and second electronic displays and the at least one alarm component.

To the accomplishment of the foregoing and related ends, the one or more embodiments include the features hereinafter fully described and particularly pointed out in the claims. The following description and the annexed drawings set forth in detail certain illustrative aspects of the one or more embodiments. These aspects are indicative, however, of but a few of the various ways in which the principles of various embodiments may be employed and the described embodiments are intended to include all such aspects and their equivalents.

DETAILED DESCRIPTION

Figure 1:
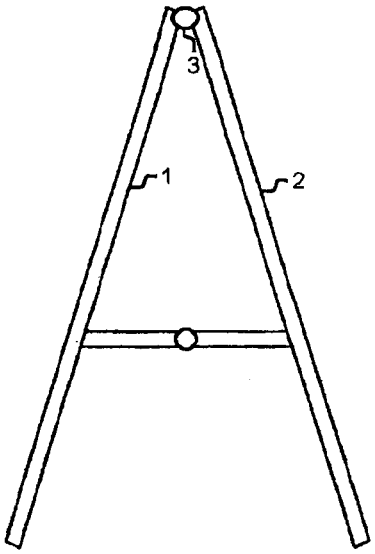
FIG. 1 shows a standard 'A'-frame (prior art).

FIG. 1 provides an overview of a known 'A'-Frame design. With two flat surfaces 1, 2 in a hinged construction 3. The board may be collapsed for storage and folded out for display.

Figure 2A:
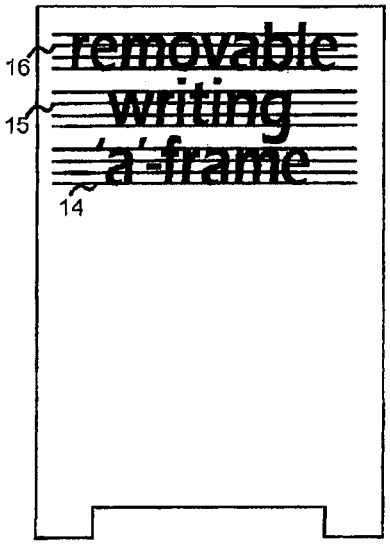
FIGS. 2A-B show an 'A'-frame with removable writing (prior art).
Figure 2B:
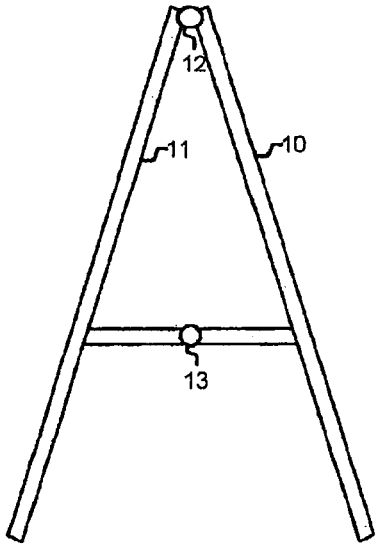

FIGS. 2A-B provide an overview of a similar known 'A'-frame design with removable lettering. Again the basic design consists of two flat surfaces 10, 11 in a hinged 12, 13 construction. In this example the writing 14, 15, 16 is removable, enabling customization of what is displayed. The board may be collapsed for storage and folded out for display.

Figure 3A:
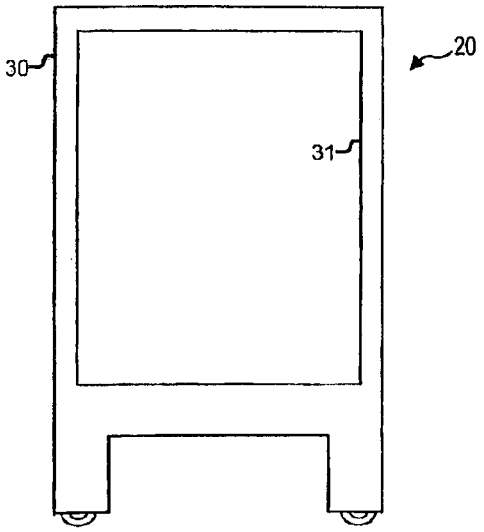
FIG. 3A-B illustrate an embodiment of an improved 'A'-frame design with build in screens.
Figure 3B:
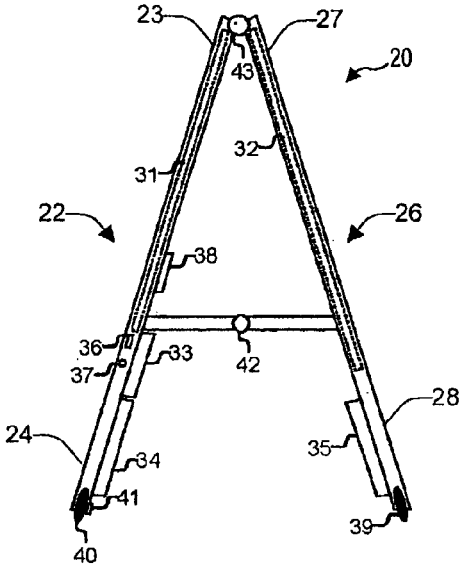

In accordance with one or more aspects of the embodiments described herein, FIGS. 3A-B show an example embodiment of an apparatus/system 20 for the display of content (e.g., advertising). For example, the apparatus 20 may include a first planar body 22 extending from a first top region 23 to a first bottom region 24, the first planar body 22 comprising a first electronic display 31 between the first top and bottom regions 23, 24. The apparatus 20 may include a second planar body 26 extending from a second top region 27 to a second bottom region 28, the second planar body 26 comprising a second electronic display 32 between the second top and bottom regions, 27, 28. The apparatus 20 may include a connector 43 for connecting the first and second planar bodies 22, 26 near the first and second top regions 23, 27.

In related aspects, the apparatus 20 may include at least one controller component/unit 33 operatively coupled to the first and second electronic displays 31, 32. The at least one controller component 33 may be configured to control the content displayed on the first and/or second electronic displays 31, 32.

In further related aspects the apparatus 20 may include at least one alarm component/system 38 attached to at least one of the first and second planar bodies 22, 26. In the present example, the at least one alarm component 38 is attached to the back of the first planar body 22.

In yet related aspects, the apparatus 20 may include at least one power component operatively coupled to the first and second electronic displays 31, 32 and the at least ones alarm component 38. In the present example the at least one power component includes a first power component 34 attached to the first planar body 22, and a second power component 35 attached to the second planar body 26.

Figure 4A:
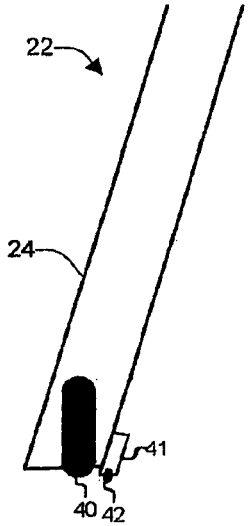
FIG. 4A-B illustrate an embodiment of an alarm system that may be included as part of the improved 'A'-frame design.
Figure 4B:
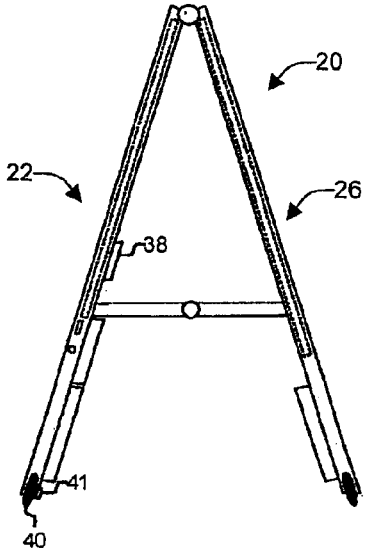

In still further related aspects the apparatus 20 may include at least one movement detection component operatively coupled to the at least one alarm component 38. With reference to the embodiment shown in FIGS. 4A-B, the at least one movement detection component may include retractable members 39, 40 (e.g., retractable wheels). Each retractable member may be coupled to an actuator (e.g., actuator 42 coupled to wheel 40). Each actuator may further be coupled to a pressure switch (e.g., pressure switch 41 coupled to the actuator 42) or the like.

In accordance with one aspect, at least one of the first and second electronic displays 31, 32 may be a liquid crystal display (LCD) screen or the like. In accordance with another aspect, the first top region 23 may include a first top edge, and the second top region 27 may include a second top edge. The connector 43 may include a hinge or the like that connects the first and second edges and allows the first and second planar bodies 22, 26 to rotate relative to each other about an axis of rotation.

In accordance with another aspect, the apparatus 20 may include a secondary connector 42 located below the connector 43, wherein the secondary connector 42 is configured to connect the first and second planar bodies 22, 26. For example, the secondary connector 42 may also be a hinge construction or the like.

In accordance with another aspect, the at least one controller 38 may include at least one processor and/or a universal serial bus (USB) interface 36 or other suitable interface, wired or wireless. The at least one controller 38 may include or interface with a digital versatile disc (DVD) playback device or the like. The at least one controller 38 may include a communication component for receiving the content, or portions thereof, from remote content provider(s) via a wired and/or wireless connection. The at least one power component 34, 35 may include battery pack(s) and/or a power supply inlet(s) (e.g., inlet 37).

In accordance with another aspect, the at least one alarm component 38 may include at least one processor, and the at least one movement detection component may include at least one actuator (e.g., actuator 42) operatively coupled to at least one pressure switch (e.g., pressure switch 41) or the like. The at least one movement detection component may include a first retractable wheel 40 in the first bottom region 24 and coupled to a first pressure switch 41, as well as a second retractable wheel 39 in to the second bottom region 28 and coupled to a second pressure switch (not shown). The first and second wheels may be configured to retract in response to the apparatus 20 being set on a floor, thereby depressing the pressure switches. Also, the first and second wheels 40, 39 may be configured to protract in response to the apparatus 20 being moved, thereby no longer depressing the first and second pressure switches, resulting in activation of the at least one alarm component 38. The first wheel 40 may be coupled to the first pressure switch 41 via a first actuator 42. Likewise, the second wheel 39 may be coupled to the second pressure switch via a second actuator.

In accordance with another aspect, the at least one alarm component 38 may be in operative communication with the at least one controller 33. The at least one alarm component 38 may instruct the at least one controller 33 to display an alarm message on at least one of the first and second electronic displays 31, 32, in response to the at least one movement detection component being triggered.

For example, as shown in FIGS. 3A-B, the apparatus 20 may incorporate an 'A'-frame design 30 with built in screens 31, 32 on both sides. The information displayed by the screens may be fed from a controller unit 33 which may be powered by one or more battery packs 34, 35 or other power supplies. The controller unit 33 may be programmed using an USB interface 36 or the like. The battery packs may be charged via a power source which may be connected to an inlet 37. An alarm system 38 may be activated when the wheels 39, 40 are retracted and the pressure switch 41 is depressed. When the unit is moved, the pressure switch 41 may be released and the alarm system 38 may be activated. The board 20 may be of a hinged 42, 43 design and may be collapsed for storage and folded out for display.

With reference once again to FIGS. 4A-B, there is shown an example alarm system activation. The advertising board 20 may be placed on the ground. The weight of the board forces the wheel 40 to retract. This causes the actuator 42 on the pressure switch 41 to be depressed. The alarm is now activated. Movement of the advertising board 20 would cause the release of the actuator 42 causing the alarm 38 to be triggered.

Those of skill would further appreciate that the various illustrative logical blocks, modules, circuits, and algorithm steps described in connection with the disclosure herein may be implemented as electronic hardware, computer software, or combinations of both. To clearly illustrate this interchangeability of hardware and software, various illustrative components, blocks, modules, circuits, and steps have been described above generally in terms of their functionality. Whether such functionality is implemented as hardware or software depends upon the particular application and design constraints imposed on the overall system. Skilled artisans may implement the described functionality in varying ways for each particular application, but such implementation decisions should not be interpreted as causing a departure from the scope of the present disclosure.

The previous description of the disclosure is provided to enable any person skilled in the art to make or use the disclosure. Various modifications to the disclosure will be readily apparent to those skilled in the art, and the generic principles defined herein may be applied to other variations without departing from the spirit or scope of the disclosure. Thus, the disclosure is not intended to be limited to the examples and designs described herein but is to be accorded the widest scope consistent with the principles and novel features disclosed herein.

What is claimed is:

1. An electronic advertising billboard, comprising:

a generally planar billboard body extending from a top region to a bottom region, said generally planar billboard body disposed at an angle relative to the ground and comprising an electronic display facing in one direction and configured to display advertising;

a communication component configured to receive advertising content from a remote content provider via a wireless connection;

at least one controller component operatively coupled to said electronic display, said at least one controller component configured for receiving advertising display content from said communication component and displaying the advertising content on said electronic display;

at least one rechargeable battery pack fixedly attached to a base of the billboard powering said communication component, said at least one controller component, and said electronic display, said at least one rechargeable battery pack disposed adjacent the bottom region of said generally planar billboard body to lower the centre of gravity and impede toppling of the billboard, wherein said generally planar billboard body and said electronic display are angled over said battery pack; and wheels, for wheeling the billboard around, the wheels located proximal to respective edges of the billboard.

2. The electronic advertising billboard according to claim 1, further comprising at least one movement detection component carried by the billboard that is operatively connected to said at least one controller component with said at least one controller component further configured to display an alarm message on said electronic display in response to triggering of said at least one movement detection component.

3. The electronic advertising billboard according to claim 2, further comprising an alarm component that is operatively connected to said at least one movement detection component.

4. The electronic advertising billboard according to claim 3, wherein said alarm component is configured to instruct said at least one controller component to display said alarm message on said electronic display in response to triggering of said at least one movement detection component.

5. The electronic advertising billboard according to claim 1, wherein said wheels include a pair of wheels located proximal to respective edges of the billboard.

6. The electronic advertising billboard according to claim 1, wherein the billboard has an A-frame design.

7. The electronic advertising billboard according to claim 1, further including a connector comprising a hinge.

8. The electronic advertising billboard according to claim 1, wherein said at least one controller component is configured to control advertising content displayed on said electronic display.

9. The electronic advertising billboard according to claim 1, further including a playback device and wherein said at least one controller component includes or interfaces with said playback device.

10. The electronic advertising billboard according to claim 1, further including at least one alarm component attached to the billboard.

11. The electronic advertising billboard according to claim 10, including a display configuration and a transport configuration, wherein the alarm is configured to activate when the billboard moved from the display configuration to the transport configuration.

12. The electronic advertising billboard according to claim 1, further including at least one movement detection component that is attached to said at least one alarm component.

13. The electronic advertising billboard according to claim 12 wherein:

said at least one movement detection component includes at least one retractable member operatively coupled to at least one pressure switch via at least one actuator;

said at least one retractable member is configured to retract in response to a weight of the billboard, thereby depressing said at least one pressure switch via said at least one actuator; and said at least one retractable body is configured to protract in response to said billboard being moved, thereby no longer depressing said at least one pressure switch, resulting in activation of said alarm component.

14. The electronic advertising billboard according to claim 12 wherein:

said alarm component is in operative communication with said at least one controller component; and said alarm component is configured to instruct said at least one controller component to display an alarm message on said electronic display in response to said at least one movement detection component being triggered.

* * * * *